US005551593A

United States Patent [19]

Wiens

[11] Patent Number: 5,551,593

[45] Date of Patent: Sep. 3, 1996

[54] COMBINATION FOOD AND BEVERAGE PLATE

[76] Inventor: Duane D. Wiens, 7269 S. Cook Cir., Littleton, Colo. 80122

[21] Appl. No.: 567,216

[22] Filed: Dec. 5, 1995

Related U.S. Application Data

[63] Continuation of Ser. No. 324,716, Oct. 18, 1994, abandoned.

[51] Int. Cl.[6] ..... B65D 1/36

[52] U.S. Cl. ..... 220/575; 220/556; 220/23.8; 220/914

[58] Field of Search ..... 220/914, 575, 220/556, 23.8, 23.83, 23.86, 574, 574.1; 206/515

[56] References Cited

U.S. PATENT DOCUMENTS

| | | | |
|---|---|---|---|
| D. 91,069 | 11/1933 | Guild . | |
| D. 115,730 | 7/1939 | Brandes et al. . | |
| D. 183,047 | 6/1958 | Helmer . | |
| D. 201,696 | 7/1965 | Zorn . | |
| D. 242,106 | 11/1976 | Caner | 220/23.8 |
| D. 270,324 | 8/1983 | French . | |
| D. 291,957 | 9/1987 | Stevens . | |
| D. 326,799 | 6/1992 | Vanderzell . | |
| 1,595,356 | 8/1926 | Moseman | 220/556 |
| 2,107,023 | 2/1938 | Bertsch | 220/23.8 |
| 4,516,685 | 5/1985 | French . | |
| 4,607,758 | 8/1986 | Stevens . | |
| 4,966,297 | 10/1990 | Doty . | |
| 5,085,391 | 2/1992 | Berger et al. . | |
| 5,111,960 | 5/1992 | Zilliox | 220/575 |
| 5,152,398 | 10/1992 | Forestal et al. | 220/556 |
| 5,184,750 | 2/1993 | Moller . | |
| 5,294,000 | 3/1994 | Yanuzzi | 220/914 |
| 5,323,910 | 6/1994 | van de Graaf, Jr. . | |
| 5,335,787 | 8/1994 | Finchum et al. . | |
| 5,429,266 | 7/1995 | D'Oliveira et al. | 220/23.83 |

FOREIGN PATENT DOCUMENTS

| | | | |
|---|---|---|---|
| 398273 | 11/1990 | European Pat. Off. | 220/556 |
| 2683708 | 5/1993 | France | 220/575 |
| 255643 | 7/1926 | United Kingdom | 220/23.8 |
| 266528 | 3/1927 | United Kingdom | 220/23.8 |
| 2078493 | 1/1982 | United Kingdom . | |
| 2118430 | 3/1982 | United Kingdom . | |

*Primary Examiner*—Stephen J. Castellano
*Attorney, Agent, or Firm*—Welsh & Katz, Ltd.

[57] ABSTRACT

A food and beverage plate is provided having a thumb slot disposed on an upper surface along a periphery of the food and beverage plate parallel to an axis passing through a center of the food and beverage plate. A beverage recess is disposed in the food and beverage plate proximate the thumb slot on a first side of the axis and a food recess is disposed in the food and beverage plate proximate the thumb slot substantially on a second side of the axis.

9 Claims, 2 Drawing Sheets

COMBINATION FOOD AND BEVERAGE PLATE

This application is a continuation of Ser. 08/324,716 filed on Oct. 18, 1994, now abandoned.

BACKGROUND OF THE INVENTION

This invention relates to food trays and more particularly to a food and beverage plate designed so that a user can simultaneously support the plate and a beverage container thereon with a single hand.

The problems of conveniently holding and trying to consume food and drinks at crowded social functions where guests remain standing or do not have tables and chairs upon which to eat, are well known. The problem comes from holding a food plate in one hand and a beverage in the other hand. With both hands occupied, it is difficult, if not impossible for the guests to eat, either through the use of an eating utensil such as a fork or with one's fingers.

To solve the problem of eating in such a situation, a guest will often attempt to balance the beverage upon the food plate held in one hand while at tempting to eat with the other hand. If an upset doesn't occurs, either the beverage container will slide across the plate, becoming sticky and contaminated with food, in the process, or the food will slide onto the container for the beverage, resulting in the same problem.

One solution to retaining the beverage container in a predetermined location on a food and beverage plate is provided by Doty in U.S. Pat. No. 4,966,297 (Doty). Doty improves the stability of the beverage container by providing a tray with a raised separator dividing a food area from a beverage container area. A pair of gaps are also provided in a sidewall of the tray so that the user may grasp the beverage container between a thumb and forefinger while supporting the tray with the remaining fingers of the same hand.

While Doty appears to improve the stability of the beverage container, the beverage container may still often become contaminated with food due to the limited height of the separator. The user, while eating, must also separately hold the tray with his other hand while drinking from the beverage container.

Another solution to the problem of supporting a beverage container on a tray is provided by Steven in U.S. Pat. No. 4,607,758 (Stevens). While Stevens appears to prevent contamination of the beverage by providing a higher barrier between a food portion of the tray and a beverage portion, the tray is limited to use with long-stem beverage containers. The Stevens tray also fails to provide a convenient method of grasping the tray while drinking from the beverage container.

Another solution to the problem of balancing a plate is provided by Finchum et al. in U.S. Pat. No. 5,335,787 (Finchum). Finchum provides a barrier, attempting to prevent contamination of the beverage container on a tray. Finchum also provides thumb placement regions adjacent a beverage container recess for grasping the tray.

While Finchum appears to provide a means for grasping the tray, the thumb placement region is not sufficiently centered to balance the weight of the food against the weight of the beverage container. Further, no provisions are made to prevent upset due to lateral movement of a user's thumb within the thumb placement region due to sudden imbalance of the tray.

Stability of a food and beverage plate is critical to its intended use. Doty, Steven and Finchum fail to address the issue of stability by failing to provide a comfortable or secure means of holding a food and beverage plate during the sudden imbalances that are to be expected in crowded social functions.

SUMMARY OF THE INVENTION

Accordingly, it is a primary objective of the present invention to provide a food and beverage plate or dish which is capable of supporting a beverage container and food while being securely held within one hand of a user.

It is a further object that the food and beverage plate or dish be capable of being held with less fatigue than that associated with prior art devices.

It is a further object that the food and beverage plate or dish be stackable with others similarly constructed food and beverage plates.

These and other objects of the present invention are provided in an apparatus of the present invention. The apparatus of the present invention includes a thumb slot disposed on a surface along a periphery of the food and beverage plate, parallel to an axis passing through a center of the food and beverage plate. The surface has no through holes or through slots. A beverage recess is disposed in the food and beverage plate proximate the thumb slot on a first side of the axis and a food recess is disposed in the food and beverage plate proximate the thumb slot substantially on a second side of the axis.

BRIEF DESCRIPTION OF THE DRAWINGS

The features of the present invention which are believed to be novel are set forth with particularity in the appended claims. The invention itself, however, together with further objects and advantages thereof, may best be understood with reference to the following description when taken in conjunction with the accompanying drawings, in which:

DETAILED DESCRIPTION OF A PREFERRED EMBODIMENT

The solution to the problem of securely grasping a food and beverage plate or dish supporting a beverage container and food lies, conceptually, in disposing a grasping location with a thumb slot along a periphery of the food and beverage plate in a position which balances the road of the beverage container against the load of the food. The thumb slot (recess) is disposed on a top side of the food and beverage plate with a longitudinal axis of the thumb recess extending radially through a center of the food and beverage plate allowing the fingers of the user to extend as far under the plate as possible and allowing the plate to be centrally supported by the user's fingertips. The radial orientation of the thumb slot also allows the user's forefinger and smallest finger to be spread apart in such a manner as to offer exceptional seability against upset caused by collisions with other guests at social functions or the sudden placement of food or beverages in the food and beverage plate. The radial positioning of the thumb slot and central positioning of the fingertips under the food and beverage plate also reduces the cantilever forces associated with holding the plate and thereby the fatigue of holding the plate.

Figure 1:
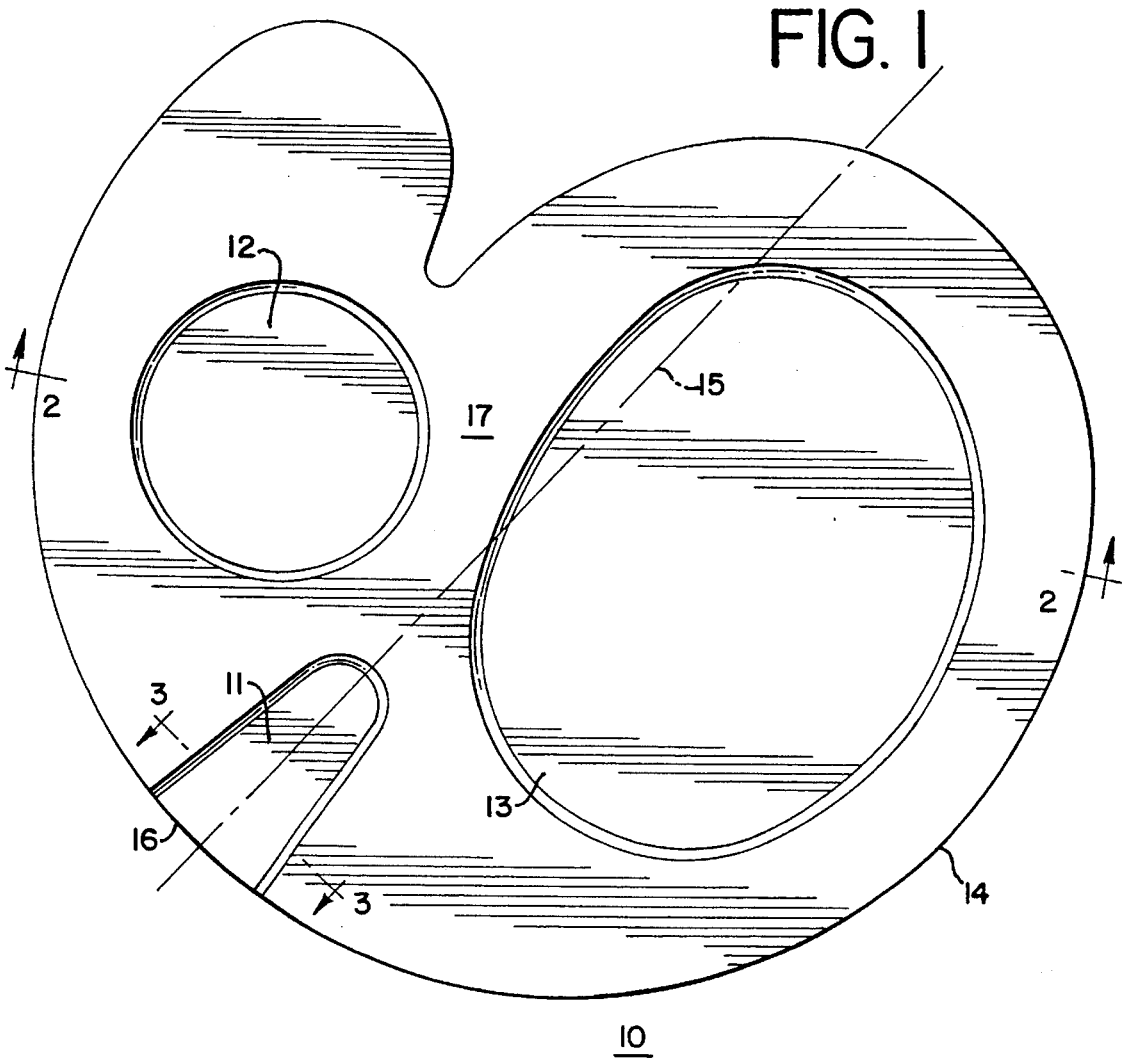
FIG. 1 is a top perspective view of the food and beverage plate under an embodiment of the invention.

FIG. 1 is a top perspective view of the food and beverage plate 10 in accordance with an embodiment of the invention. The major diameter of the food and beverage plate 10 is 8.75 inches with the features of the food and beverage plate 10 proportioned as shown in FIG. 1. The food and beverage plate 10 is ⅝ inch deep. Under one embodiment of the invention, the food and beverage plate 10 is constructed of paper. Under the embodiment, the food and beverage plate 10 may be fabricated using well known paper molding processes (e.g., those associated with making paper plates). Alternatively, the food and beverage plate may be fabricated of plastic or styrofoam using injection molding techniques. The food and beverage plate may also be made of glass, ceramic, porcelain or wood.

Under the invention the thumb slot 11 is disposed as shown in FIG. 1 along an outer periphery 14 of the food and beverage plate 10. A beverage recess 12 and a food recess 13 are disposed proximate the thumb slot 11 in the central area of the food and beverage plate 10.

The thumb slot 11 is disposed radially to the food and beverage plate 10 along an axis 15 which may or may not pass through a central balance point of the plate 10 when empty. The purpose of the axis 15 (and thumb slot 11) is to provide a convenient point of balance during use. The thumb slot 11 also provides a convenient grasping point which engages a thumb of a user via a pair of thumb slot side walls 18, 19. Thumb slot side walls 18, 19 do not allow for lateral slip of the user's thumb during use or for consequent upset during sudden imbalances.

The beverage recess 12 is sized to receive a variety of beverage containers (e.g., a 12 ounce soft drink container). Also, since the beverage recess 12 will typically support more weight (e.g., a 12 ounce soft drink container) the overall diameter of the recess 12 is located closer to the axis 15 and to an outer periphery 16 of the thumb slot 11 than is the food recess 13.

The food recess 13, by necessity, is larger and is located further from the periphery 16 of the thumb recess 11. It should be noted, on the other hand, that the distance between the center of the food recess 13 and axis 15 and the distance between the center of the beverage recess 12 and axis 15 are comparable.

The thumb recess 11, beverage recess 12, and food recess 13 are joined together and supported by a flange 17 that may be flat, having no through holes or through slots, as shown in FIG. 1, or the edges may be beveled or rolled-under along the periphery 14. The overall shape of the periphery of the flange may be of an arbitrary shape, as shown in FIG. 1, or round.

Figure 2:
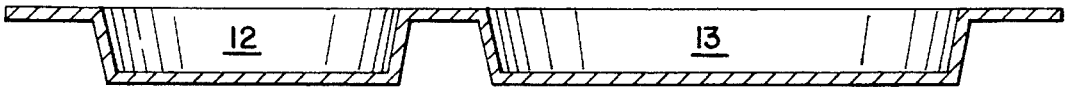
FIG. 2 is a cut-away view of the food and beverage plate of FIG. 1 along section 2—2.

In the case where a user of the food and beverage plate 10 were to find a table at which to eat, the part tray 10 is provided with relatively flat surfaces on the bottom of the beverage recess 12, food recess 13 and thumb recess 11 (FIG. 2). The flat bottom of the three recesses 11, 12, 13 provides a stable three-point balance system for table use.

Figure 3:
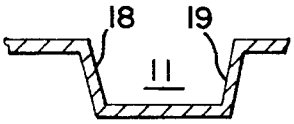
FIG. 3 is a cut-away view of the food and beverage plate thumb slot of FIG. 1 along section 3—3.

The side walls of the thumb slot 11 and recesses 12, 13 are also tapered from top to bottom (FIGS. 2 and 3). The tapering of the thumb slot 11 and recesses 12, 13 allows the food and beverage plate 10 to be stacked in close proximity, one to another, (nested) in a manner similar to paper plates.

Figure 4:
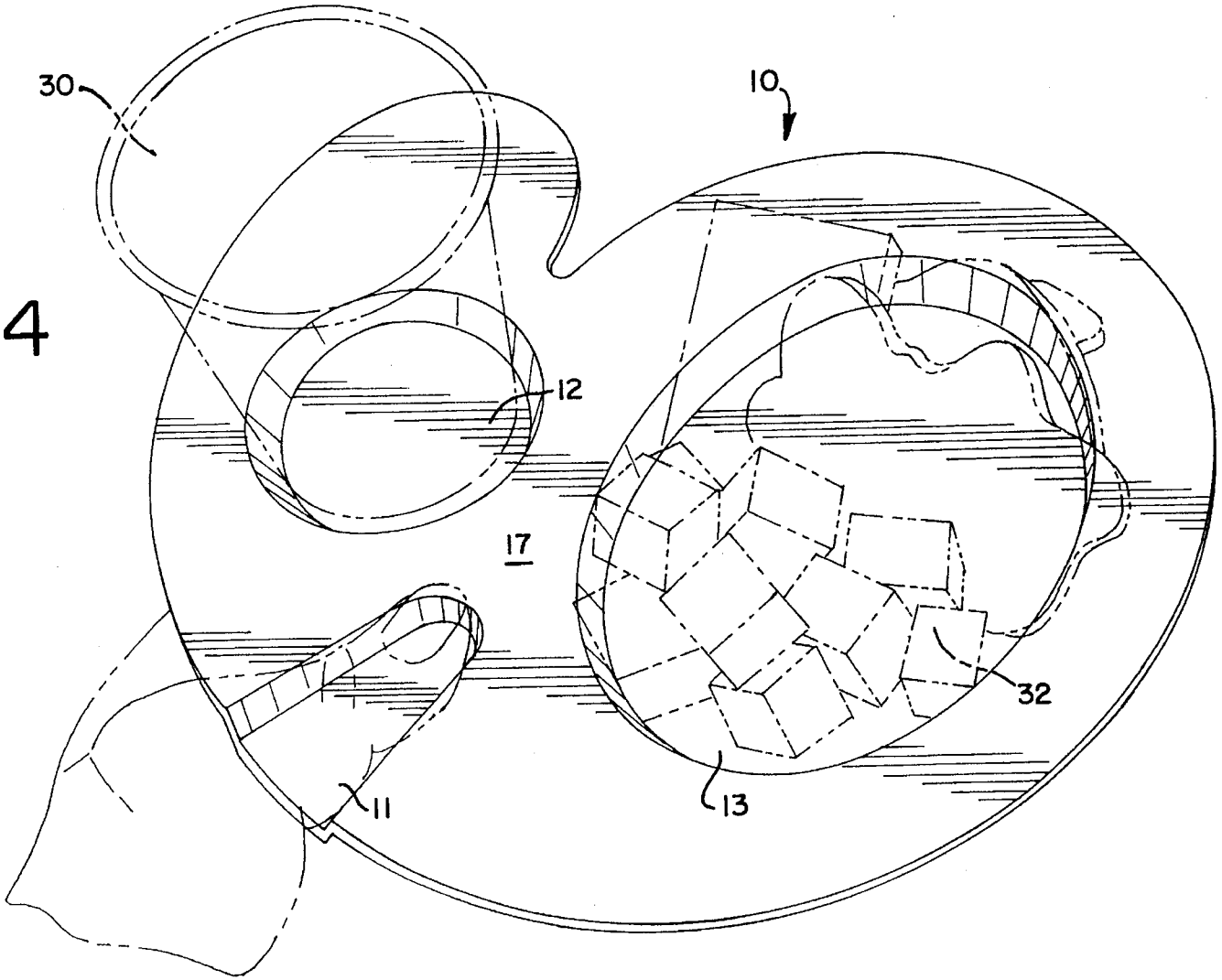
FIG. 4 is a top perspective view of the combination food and beverage plate of FIG. 1.

FIG. 4 is a top perspective view of the food and beverage plate 10 of the present invention supporting a beverage container 30 in the beverage recess 12 and a quantity of food 32 in the food recess 13. The food and beverage plate 10 is shown supported within a hand of the user with the thumb of the user securely engaging the thumb slot side walls 18,19. The balancing of the beverage container and food on either side of the thumb slot 11 demonstrates the stability and ease of use of the food and beverage plate 10.

The present invention provides a food and beverage plate or dish capable of conveniently and comfortably supporting both beverage and food. The centrally located thumb slot allows a user to securely grasp the food and beverage plate with less chance of upset.

While specific embodiments of the present invention have been shown and described herein, further modifications and improvements may be made by those of skill in the art. All such modifications which retain the basic underlying principles disclosed and claimed herein are within the scope of the invention.

What is claimed is:

1. A food and beverage plate comprising:

a substantially continuous surface having no through holes or through slots;

a thumb recess disposed in the surface along a periphery of the food and beverage plate, with a longitudinal axis of the thumb recess passing substantially through a center of the continuous surface of the food and beverage plate;

a beverage recess disposed in the food and beverage plate proximate the thumb recess on a first side of the axis; and a food recess disposed in the food and beverage plate proximate the thumb recess substantially on a second side of the axis.

2. The food and beverage plate as in claim 1 further comprising a support flange, joining and supporting the thumb recess, beverage recess and food recess.

3. The food and beverage plate as in claim 1 wherein the thumb recess beverage recess and food recess further comprise a flat bottom three-point support structure when the food and beverage plate is placed on a table or other flat structure.

4. The food and beverage plate as in claim 1 wherein the thumb recess, beverage recess and food recess are tapered for stacking with other food and beverage plates of the same construction.

5. The food and beverage plate as in claim 1 fabricated of one of a group of materials comprising; paper, plastic, styrofoam, glass, ceramic, porcelain and wood.

6. A food and beverage plate comprising:

a flange having a generally circular shape and a substantially continuous surface having no through through holes or through slots;

a thumb recess disposed in the flange along a periphery, with a longitudinal axis of the thumb recess passing substantially through a center of the food and beverage plate;

a beverage recess disposed in the flange on a first side of the axis; and a food recess disposed in the flange substantially on a second side of the axis in a balancing relationship to the beverage recess, said thumb recess, beverage recess and food recess being spaced such that when a user grasps the food and beverage plate with a thumb of the user in the thumb recess, the user's splayed fingers support the undersides of the beverage and food recesses thereby balancing the food and beverage tray about the longitudinal axis.

7. The food and beverage plate as in claim 6 wherein the thumb recess, beverage recess and food recess further comprise a flat bottom three-point support structure for the food and beverage plate when the food and beverage plate is placed on a table or other flat structure.

8. The food and beverage plate as in claim 6 wherein the thumb recess, beverage recess and food recess are tapered for nesting with other similarly constructed food and beverage plates.

9. The food and beverage plate as in claim 6 fabricated of one of a group of materials comprising; paper, plastic, styrofoam, glass, ceramic, porcelain and wood.

* * * * *